United States Patent [19]

Ponter

[11] 4,007,618

[45] Feb. 15, 1977

[54] RETROFIT METHOD AND APPARATUS FOR ROLLING MILLS

[75] Inventor: Robert J. Ponter, Glenshaw, Pa.

[73] Assignee: Ritter Engineering Company, Pittsburgh, Pa.

[22] Filed: Mar. 22, 1976

[21] Appl. No.: 669,171

[52] U.S. Cl. ..... 72/245

[51] Int. Cl.[2] ..... B21B 31/32

[58] Field of Search ..... 72/245, 246, 199; 29/200 D

[56] References Cited

UNITED STATES PATENTS

| | | | |
|---|---|---|---|
| 2,676,465 | 5/1954 | Schnook et al. | 72/245 X |
| 3,111,047 | 11/1963 | Metzger | 72/245 |

*Primary Examiner*—Milton S. Mehr

*Attorney, Agent, or Firm*—McNenny, Pearne, Gordon, Gail, Dickinson & Schiller

[57] ABSTRACT

An apparatus and method are provided for retrofitting a hydraulic roll actuating mechanism in a screw down rolling mill. A hydraulic cylinder is fitted to the mill frame in the situs of the original screw down mechanism, and an externally threaded piston rod sleeve which coaxially extends from the hydraulic cylinder and receives the piston rod is disposed within the frame opening which originally accommodated the screw member. The piston rod sleeve is threadedly engaged with the original screw nut carried by the frame for purposes of transmitting reaction forces to the frame.

16 Claims, 2 Drawing Figures

RETROFIT METHOD AND APPARATUS FOR ROLLING MILLS

BACKGROUND OF THE INVENTION

The present invention provides an apparatus and method for retrofitting a hydraulic roll actuating mechanism in a screw down rolling mill. In accordance with the present invention, an exterior housing element of the frame of the screw down mill is replaced by a hydraulic cylinder adapted to use the housing mounts, and to be positioned over the vertical opening in the frame which originally accommodated the actuating screw member. A piston rod sleeve extending from the hydraulic cylinder and enclosing the piston rod is fitted within the original screw member opening and threadedly engaged with the existing screw nut for transmitting reaction forces to the frame.

The provision of hydraulic roll actuation is frequently desired in existing screw down rolling mills to eliminate the inefficiencies of the mechanical screw arrangement and to provide the control advantages associated with the fast response to hydraulic systems. Presently, the conversion of a screw down mill to hydraulic actuation is a time consuming and expensive process. For example, the known conversion techniques and apparatus typically necessitate a month of mill down time which results not only in the direct conversion expenses but also the loss of significant production time.

In the conversion of rolling mills, it is desirable to avoid alteration of the frame since this not only generates significant expenses but also tends to reduce the frame structure and the capacity of the mill. Accordingly, conversion procedures have heretofore favored techniques wherein the hydraulic system is essentially fitted within the mill window either above the top backup chock or below the bottom backup chock. The fitting of the hydraulic system within the mill window imposes severe design restraints upon the hydraulic unit and, in many instances, the desired hydraulic unit still cannot be fitted within the mill window without significant reworking of the mill frame or backup chocks.

When a mill is originally designed for hydraulic actuation, it is desirable to locate the hydraulic unit clear of the mill window as illustrated in U.S. Pat. Nos. 3,242,711 and 3,435,649. In original designs, the remote disposition of the hydraulic cylinder allows sufficient space for preferred cylinder designs and removes the cylinder from the unfavorable environment of the rolling process. In addition, the unobstructed positioning of the hydraulic cylinder facilitates subsequent maintenance and enables certain control advantages.

SUMMARY OF THE INVENTION

In accordance with the present invention, an apparatus and method for retrofitting a hydraulic roll actuating mechanism in a screw down rolling mill are provided. A hydraulic cylinder is fitted to the frame of the mill in an orientation corresponding to the original screw drive mechanism with or without limited reworking of the frame of the mill. The hydraulic cylinder is fitted adjacent the opening in the frame which originally accommodated the screw member, and a piston rod sleeve is mounted within the opening for receiving a piston rod. The piston rod sleeve has external threads which threadedly engage the original screw nut of the mill. In this manner, the existing screw down mill structure is efficiently fitted with the hydraulic roll actuating mechanism, and the original load capacity of the mill is not reduced since the existing load carrying, frame structure is essentially maintained.

In the illustrated embodiment, the cross sectional area of the original screw member opening is approximately equally divided between the cross sectional areas of the piston rod sleeve and piston rod. Accordingly, the hydraulic actuation forces and the resulting reaction forces imposed upon the mill frame are carried by structurally comparable members so as to maximize the capacity of the retrofitted system. In view of the inefficiencies of screw actuation wherein high torsional stresses are generated in order to provide useful compressive stresses, the substantially complete use of the existing space originally allocated to the actuation means by the hydraulic mechanism of the subject invention actually results in a more efficient mill.

As indicated above, the hydraulic cylinder is fitted to the frame in an orientation corresponding to that of the original screw drive mechanism. Generally, the screw drive mechanism is enclosed by an exterior housing element, and the original frame structure is provided with suitable mounts for securing the housing element thereto. The hydraulic cylinder can be designed or adapted to use the existing frame mounts, even though the mounts are not structurally designed to carry actuation forces or reaction forces, since the reaction forces are carried by the piston rod sleeve and directly transmitted to the frame through the existing screw nut.

DETAILED DESCRIPTION OF THE DRAWINGS

Figure 1:
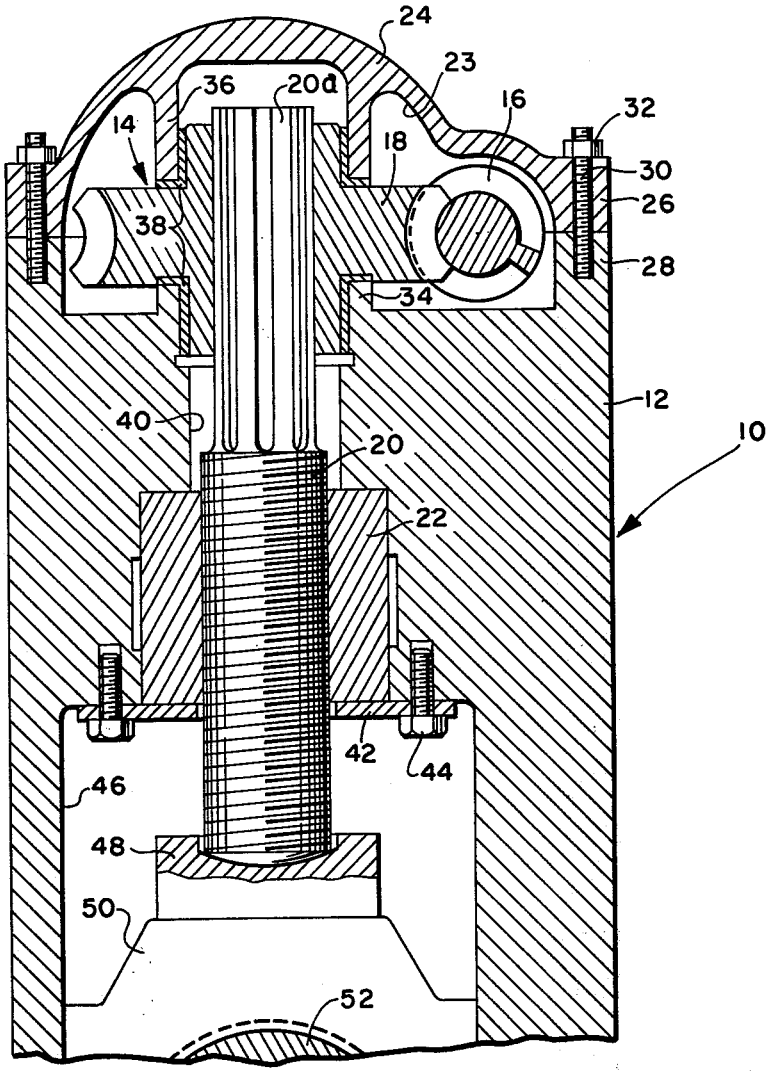
PRIOR ART FIG. 1
FIG. 1 is a cross-sectional end view of the upper portion of a conventional screw down rolling mill with certain elements shown in elevation for purposes of clarity.

Referring to FIG. 1, a conventional, screw down rolling mill 10 having a frame 12 is shown. The mill 10 is provided with a screw down actuation mechanism generally indicated at 14 for operation of the rolls of the mill. The mill 10 is of the four-high type wherein large backup rolls are employed to reinforce smaller working rolls. However, the present invention is applicable to the conversion of all of the various types of mills including two-high, three-high and the illustrated four-high mill.

The screw down actuation mechanism 14 includes as its principal parts a worm gear 16 connected to a drive motor (not shown), a worm wheel 18 which is splined to an actuating screw member 20 and a rotationally fixed screw nut 22 which is threadedly engaged with the screw member 20. The worm gear 16 and the worm wheel 18 are disposed within a cavity 23 defined by the frame 12 and a housing member 24. The housing member 24 includes a peripheral flange 26 which is configured to engage a mounting skirt 28 provided by the frame 12. The housing member 24 is secured to the frame 12 by means of studs 30 which are threadedly engaged with the mounting skirt 28 and extend through the flange 26 for engagement with nuts 32.

The worm wheel 18 is supported within the cavity 23 by means of an annular support skirt 34 provided by the frame 12 and an oppositely disposed support skirt 36 extending from the housing 24 with the interposition of suitable bearings 38. As indicated above, the worm wheel 18 is splined to the screw member 20 and, more particularly, an upper portion 20*a* of the screw member which comprises a spline shaft.

The screw member 20 extends through a vertical opening 40 in the frame 12, and it is threadedly engaged with the screw nut 22 which is disposed adjacent the lower end of the opening 40. The screw nut 22 is retained in position by a retainer plate 42 which is secured to the frame 12 by bolts 44. The screw member 20 extends through the opening 40 and into a mill window 46 for purposes of actuating the rolls of the mill.

The screw member 20 engages a pressure block 48 for purposes of operating a top backup chock 50 which is mounted within the mill window 46. The backup chock 50 engages a backup roll 52 which cooperates with a top work roll (not shown) and conventional bottom work and backup rolls (not shown).

Figure 2:
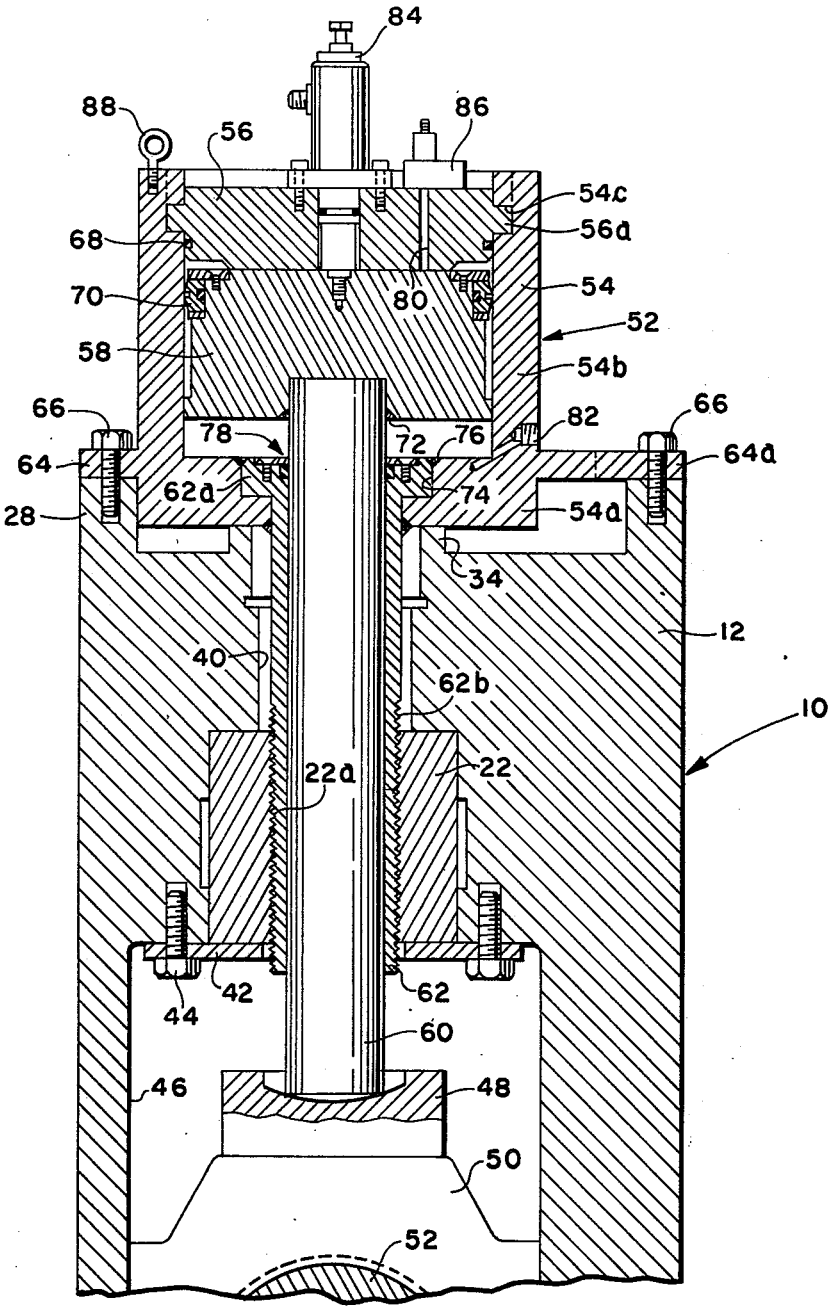
FIG. 2 is a cross-sectional end view of the rolling mill of FIG. 1 retrofitted in accordance with the present invention to provide hydraulic roll actuation.

Referring to FIG. 2, the rolling mill 10 is shown retrofitted for hydraulic roll actuation in accordance with the present invention. More particularly, the housing member 24 and the screw down actuation mechanism 14 except for the screw nut 22 have been removed, and the hydraulic retrofit apparatus generally indicated at 52 has been mounted to the frame 12. The principal parts of the hydraulic retrofit apparatus 52 comprises a hydraulic cylinder 54 including a removable end wall or closure 56, a piston 58, and a piston rod 60 which is received within a piston rod sleeve 62 extending from the hydraulic cylinder 54.

The hydraulic cylinder 54 is mounted to the frame 12 in substantially the same position as the housing member 24. The hydraulic cylinder 54 has a substantially circular cross section, and it is mounted above the opening 40 so that the piston 58, piston rod 60 and piston rod sleeve 62 are coaxial with the opening. To that end, the hydraulic cylinder 54 is provided with a peripheral flange 64 which is configured to fit the mounting skirt 28 of the frame 12. To accommodate the non-symmetrical configuration of the mounting skirt 28 with respect to the axis of the opening 40, the peripheral flange 64 is provided with a radially extending ear 64*a*. In the retrofitting operation, the studs 30 and nuts 32 shown in FIG. 1 have simply been replaced by bolts 66.

The hydraulic cylinder 54 includes a bottom wall 54*a* which is supported on the annular support skirt 34 and substantially disposed within the lowermost portion of the original cavity 23 (FIG. 1). Accordingly, the hydraulic retrofit apparatus efficiently utilizes the space rendered available by removal of the screw down actuation mechanism 14 and maximizes support by use of the skirts 28, 34.

The hydraulic cylinder 54 also includes an axially extending, cylindrically shaped sidewall 54*b* which is integrally formed with the bottom wall 54*a*. As indicated above, the hydraulic cylinder 54 is provided with a removable end closure 56 which is fitted adjacent the upper end of the cylinder. The fixing of the end closure 56 to the cylinder 54 is particularly advantageous since it enables the retrofit apparatus 54 to directly transmit reaction forces to the frame 12 by means of the piston rod sleeve 62 and screw nut 22 as indicated below in greater detail.

The end closure 56 is secured to the sidewall 54*b* of the cylinder 54 by a bayonet connection. To that end, the end closure 56 is provided with a bayonet rib 56*a* which is rotationally locked within a bayonet channel 54*c* provided in the sidewall 54*b*. The end closure 56 is provided with an O-ring 68 for purposes of forming a hydraulic seal.

As shown in FIG. 2, the piston 58 is in a fully retracted position with its upper surface disposed adjacent the lower surface of the end closure 56. The piston 58 is provided with an O-ring seal 70 for purposes of forming a hydraulic seal. The piston rod 60 is fitted within a recess in the lower surface of the piston 58, and it is secured to the piston for following movement by suitable means such as weld 72. The piston rod 60 extends downwardly from the piston 58 through the sleeve 62 and into engagement with the pressure block 48.

The piston rod sleeve 62 is disposed in a shouldered opening 74 in the bottom wall 54*a*, and it is secured to the hydraulic cylinder 54 in a convenient manner such as by weld 76. Accordingly, the piston sleeve 62 is provided with a radial flange 62*a* which is received in the shouldered opening 74. The flange 62*a* is hydraulically sealed by means of an O-ring and retainer plate assembly 78 disposed about the piston rod 60.

The piston rod sleeve 62 has a cylindrical configuration, and its outside diameter is sized to substantially almost fill the smallest diameter of the vertical opening 40. The lower portion of the sleeve 62 adjacent the mill window 46 is provided with external threads 62*b* for engaging the internal threads 22*a* of the screw nut 22. In this manner, the existing screw nut 22 is advantageously used to transmit the hydraulic reaction forces to the frame 12 of the mill.

The cross sectional area of the piston rod sleeve 62, aside from the flange 62*a*, is selected to be approximately equal to one-half of the cross-sectional area defined by the smallest diameter of the opening 40. Further, the cross-sectional area of the piston rod 60 is also approximately equal to one-half of the area of the opening 40 and equal to the cross-sectional area of the sleeve 62. In this manner, the load bearing capacity of each of the elements as well as the hydraulic system is maximized.

The hydraulic retrofit apparatus 52 includes a first hydraulic port 80 extending through the removable end closure 56 to the upper surface of the piston 58 and a second hydraulic port 82 extending through the sidewall 54*b* to the bottom surface of the piston 58. The ports are connected in a conventional manner to a source of hydraulic pressure (not shown), and they are arranged for both pressurizing and venting the respective operating portions of the hydraulic cylinder 54.

The hydraulic retrofit apparatus 52 can be used in both pressure rolling mill applications wherein a constant pressure is applied to the material to be rolled and automatic gauge control mills wherein the material to be rolled is provided at a substantially constant gauge by varying the applied pressure. The rolling mill 10, as shown in FIG. 2, is arranged for automatic gauge control, and a linear variable differential transformer 84 is carried by the end closure 56 for providing a hydraulic, position feedback signal. A servo valve 86 is also conveniently carried on the end closure 56. The transformer 84 and the servo valve 86 are arranged in a control system in a conventional manner to provide controlled hydraulic actuation in response to variations from a preselected control point.

As indicated above, the retrofitting of the mill 10 requires only limited reworking, if any, of the frame 12. For example, the flange 64 and the bottom wall 54*a* of the cylinder 54 as well as the piston rod sleeve 62 may be initially designed to fit the existing frame structure with or without limited reworking of the mounting skirt 28, the support skirt 34 and the opening 40 of the frame 12. The retrofit apparatus 52 can be fully assembled and fitted as a unit to the mill 10, and it can be threadedly engaged with the screw nut 22 as it is lowered into position by means of eyebolts 88 (only one of which is shown) symmetrically secured to the cylinder 54. Of course, the cylinder 54 and sleeve 62 can be initially fitted to the mill, and the remaining components of the retrofit apparatus 52 can be subsequently assembled.

The retrofitting apparatus and method of the present invention are particularly advantageous since they achieve in a retrofit situation many of the design benefits which are imparted to a mill in an original design application wherein hydraulic actuation is to be employed. As indicated above, the retrofitted hydraulic mechanism is disposed in an unobstructed position to provide adequate space for preferred cylinder design and to subsequently facilitate maintenance. The remote location of the hydraulic cylinder from the immediate environment of the rolling process is itself desirable, and it also enables the incorporation of control elements such as position feedback devices, servo valves and pressure transducers as a designed part of the hydraulic cylinder. As described in detail above with respect to the illustrated embodiment, the apparatus and method of the present invention may be readily employed to convert a screw down mill to hydraulic actuation with a minimum of effort and substantially no significant amount of frame modification. Moreover, the piston and sleeve arrangement maximize the load bearing capacity of the retrofitted mill with efficient use of the structural mill characteristics originally provided in the screw down mill design. In fact, the inefficiency of a screw mechanism as compared with hydraulic actuation and the over design of the original mill due to such inefficiency is advantageously employed in accordance with the present invention with respect to both the sizing of the hydraulic system and the use of the existing screw nut as a part thereof.

What is claimed is:

1. A method of retrofitting a hydraulic roll actuating mechanism in a screw-down rolling mill of the type including a frame having a housing element mounted thereto for enclosing screw drive means operably connected to a screw member extending through an opening in said frame toward the roll members of said mill, said screw member being threadedly engaged with a rotationally fixed screw nut carried by said frame, comprising (a) providing and fitting a hydraulic cylinder to said frame adapted to be mounted thereon in replacement of said housing element; (b) providing and inserting an externally threaded piston rod sleeve into said opening, said sleeve being coaxially secured to said hydraulic cylinder and threadedly engaged with said screw nut; and (c) providing and disposing a hydraulic piston in said hydraulic cylinder, said hydraulic piston including a piston rod extending through said sleeve and arranged for operating the roll members of said mill in replacement of said screw member.

2. A method as set forth in claim 1 wherein step (c) is performed prior to steps (a) and (b).

3. A method as set forth in claim 1 wherein step (a) includes providing said hydraulic cylinder with peripheral mounting means adapted to be secured to said frame, and fitting said peripheral mounting means to housing element frame mounts for an original housing element of the mill to secure said hydraulic cylinder to said frame.

4. A method as set forth in claim 1 wherein step (b) includes providing said piston rod sleeve with a cross-sectional area substantially equal to one-half of the cross-sectional area of said opening, and step (c) includes providing said piston rod with a cross-sectional area substantially equal to that of said piston rod sleeve.

5. A method of retrofitting a hydraulic roll actuating mechanism in a screw-down rolling mill of the type including a frame in which screw drive means have been receivable and have been operably connected to a screw member extending through a vertical opening in the frame toward the roll members of the mill, the screw member being threadedly engaged with a rotationally fixed screw nut carried by the frame, comprising (a) reworking the frame in the former situs of the removed screw drive means by limited machining or the like only to the extent, if any, necessary to securely receive a vertically oriented hydraulic cylinder positioned directly over the vertical opening and the roll members of the mill and of substantially greater diameter than that of the vertical opening, (b) providing said hydraulic cylinder and a coaxial extension in the form of an externally threaded piston rod sleeve of a diameter such as to almost fill the smallest diameter of the vertical opening and having a cross-sectional area about half of that of the smallest diameter of the vertical opening, and positioning said cylinder at said situs and extending said axial sleeve through said vertical opening and threading it into said screw nut, and (c) before, during or after step (b), disposing a hydraulic piston in said hydraulic cylinder, the hydraulic piston including a piston rod of about the same cross-sectional area as the piston rod sleeve and extending through said sleeve and arranged for operating the roll members of the mill in replacement of said screw member.

6. A method as set forth in claim 5 wherein the step of providing said hydraulic cylinder and coaxial extension includes providing said cylinder with a removable end wall oppositely disposed from said extension and secured to the cylinder by a bayonet fitting.

7. A method as set forth in claim 5 wherein the step of providing said hydraulic cylinder includes forming a peripheral flange thereon adapted to be secured to said frame and the step of reworking the frame includes fitting said peripheral flange to housing mounts on the frame which formerly engaged an exterior housing element for the screw drive means.

8. A hydraulic roll actuating apparatus for use in retrofitting a hydraulic roll actuating mechanism in a screw-down rolling mill of the type including a frame having a housing element mounted thereto for enclosing screw drive means operably connected to a screw member extending through an opening in said frame toward the roll members of said mill, said screw member being threadedly engaged with a rotationally fixed screw nut carried by said frame, comprising a hydraulic cylinder adapted to be mounted to said frame in the situs of said housing element and in replacement of said screw drive means, an externally threaded piston rod sleeve secured to said hydraulic cylinder adapted to be disposed within said opening and threadedly engaged with said screw nut, and a piston for said hydraulic cylinder including a piston rod adapted to be operably connected to said piston and to extend through said sleeve for operation of the roll members of a rolling mill.

9. A hydraulic roll actuating apparatus as set forth in claim 8 wherein said piston rod sleeve has a diameter such as to almost fill the smallest diameter of said opening in said frame.

10. A hydraulic roll actuating apparatus as set forth in claim 8 wherein said piston rod sleeve has a cross-sectional area equal to about one-half of the cross-sectional area of the smallest diameter of said opening in said frame, and said piston rod has about the same cross-sectional area as that of said piston rod sleeve.

11. A hydraulic roll actuating apparatus as set forth in claim 8 wherein said hydraulic cylinder includes peripheral mounting flange means adapted to be fitted to housing element frame mounts provided by said frame for mounting a housing element.

12. A hydraulic roll actuating apparatus as set forth in claim 8 wherein said hydraulic cylinder includes an open end cylindrical sidewall extending from an integrally formed bottom wall, said piston rod sleeve being fixed to said bottom wall and providing a coaxial opening for receiving said piston rod of said piston, and an end wall removably secured to said cylindrical sidewall for closing said open end thereof.

13. A hydraulic roll actuating apparatus as set forth in claim 12 wherein said end wall is secured to said cylindrical sidewall by a bayonet connection.

14. In retrofitting apparatus for use in retrofitting a hydraulic roll actuating mechanism in a screw-down rolling mill of the type including a frame having screw drive means operably connected to a screw member extending through a vertical opening in the frame toward the roll members of the mill, the screw member being threadedly engaged with a rotationally fixed screw nut carried by the frame: a hydraulic cylinder of substantially greater diameter than said vertical opening and adapted to be mounted to the frame in the former situs of the screw drive means, with or without limited reworking of the frame at said situs, in a vertically oriented position directly over the vertical opening and the roll members of the mill, an externally threaded piston rod sleeve of a diameter such as to almost fill the smallest diameter of the vertical opening and having a cross-sectional area about half of that of the smallest diameter of the vertical opening, said sleeve being secured to and coaxial with said hydraulic cylinder and extending vertically downwardly therefrom and being receivable in threaded engagement in said screw nut, and a hydraulic piston in said cylinder, the piston including a piston rod of about the same cross-sectional area as the piston rod sleeve and extending through the sleeve to operate the roll members of the mill in replacement of said screw member.

15. A retrofitting apparatus as set forth in claim 14 wherein said hydraulic cylinder includes a removable end wall oppositely disposed from said piston rod sleeve, said removable end wall being secured to said hydraulic cylinder by a bayonet connection.

16. A retrofitting apparatus as set forth in claim 15 wherein said hydraulic cylinder includes a peripheral flange for mounting the cylinder to said frame.

* * * * *